United States Patent [19]

Jahoda

[11] Patent Number: 4,650,111

[45] Date of Patent: Mar. 17, 1987

[54] CONVERTIBLE BOOK BOX/BOOK REST AND FOLDABLE BLANK THEREFOR

[76] Inventor: Diane Jahoda, 12304 Oakleaf Ave., Tampa, Fla. 33612

[21] Appl. No.: 817,059

[22] Filed: Jan. 8, 1986

[51] Int. Cl.[4] ..... A47B 97/04

[52] U.S. Cl. ..... 229/103; 206/45.25; 206/424; 220/339; 248/459; 281/33

[58] Field of Search ..... 206/424, 232, 45.24, 206/45.25; 248/444, 445, 447, 454, 458, 459; 281/33; 40/341; 220/339; 229/103

[56] References Cited

U.S. PATENT DOCUMENTS

| | | | |
|---|---|---|---|
| 1,728,431 | 9/1929 | Mevi | 281/33 |
| 1,918,773 | 7/1933 | Morehouse | 281/33 |
| 2,256,513 | 9/1941 | Bauer | 281/33 |
| 2,479,901 | 8/1949 | Davidson | 248/459 |
| 2,784,522 | 3/1957 | Bergman | 284/447 |
| 3,195,850 | 7/1965 | Steiner | 248/459 |
| 3,220,752 | 11/1965 | Sloves | 281/33 |
| 4,377,271 | 3/1983 | Smith | 281/33 |
| 4,560,102 | 12/1985 | Dlugopolski | 206/424 |

FOREIGN PATENT DOCUMENTS

| | | | |
|---|---|---|---|
| 458248 | 3/1928 | Fed. Rep. of Germany | 248/460 |
| 300708 | 11/1928 | United Kingdom | 281/33 |

*Primary Examiner*—William Price
*Assistant Examiner*—Gary E. Elkins
*Attorney, Agent, or Firm*—Wigman & Cohen

[57] ABSTRACT

A combination book box/book rest which can be formed from a one-piece foldable blank is disclosed. The foldable blank may be made of cardboard or plastic and comprises a flat, rectangular central section with two lateral flaps hinged to the opposite sides thereof. Upper and lower flaps are hinged respectively to the upper and lower ends of the central section. The lateral edges of the upper and lower flaps releasably engage in grooves in the lateral flaps to form a book box. The end portions of the upper and lower flaps are also releasably engagable with each other to convert the blank into an inclined book rest support.

11 Claims, 9 Drawing Figures

CONVERTIBLE BOOK BOX/BOOK REST AND FOLDABLE BLANK THEREFOR

BACKGROUND OF THE INVENTION

The present invention relates to book boxes and book rests and more particularly to a combination book box/-book rest which can be formed from a one-piece foldable blank.

Heretofore, various book rest devices have been used to provide an inclined support for books and various box designs have been used to cover or contain books, but until the development of the present invention, there has been no known device capable of serving as both a book rest and a book box. Despite the clear convenience of a device which serves both those functions, the prior art does not appear to have even addressed the problem solved by the present invention.

Examples of the various types of known book rest devices are shown in U.S. Pat. No. 1,728,431, issued to Mevi and U.S. Pat. No. 2,165,255 issued to Hamilton. Mevi discloses a book supporting device, one leg of which may be fastened directly to the binding of a book and the other leg of which supports the book in an inclined orientation for reading. Hamilton shows a collapsible cardboard device which uses a slot and tab system to achieve support. Neither device, however, is capable of serving as a book box or container.

Similarly, examples of typical book containers known in the art are shown in U.S. Pat. No. 4,215,780 issued to Carlson, and U.S. Pat. No. 4,046,311 issued to Voytko. Each of these prior art references discloses a container having a series of foldable flags which can be shaped to enclose an item such as a book or the like. However, neither of these book containers is disclosed as being capable of providing the support necessary for a book rest.

Of course, as is well-known, the prior art is replete with numerous other boxes and containers which are suitable for service as a book box of container. However, so far as is known, none of such conventional boxes or containers are especially constructed and configured for conversion to a book rest in the manner of the present invention.

SUMMARY AND OBJECTS OF THE INVENTION

In view of the aforementioned limitations and shortcomings of the prior art devices, as well as other disadvantages not specifically mentioned above, it should be apparent that there still exists a need in the art for a device which will perform both the function of containing or covering a book as well as the function of supportiong a book in an inclined position for purposes of reading. It is, therefore, a primary objective of this invention to fulfill that need by providing a device which is convertible from a book rest to a book box.

More particularly, it is an object of this invention to provide a one-piece blank which is foldable to form a stable book rest or a book box and which is easily converted from one configuration to the other.

A further object of the present invention is to provide a convertible book rest/book box which may be folded flat when not in use, for easy storage.

Another object of the invention is to provide a convertible book rest/book box which can be manufactured by cutting or molding a one-piece foldable blank of paperboard or plastic.

Yet another object of the present invention is to provide a portable book rest which can be used by a person to transport a book and then which can be folded to form a book rest to be placed upon the user's lap, a table or other planar surface for conveniently supporting the book while reading.

Still another object of the present invention is to provide a means for transporting books which will protect them from the elements as when a user is transporting a book, to a school or library, or by public transportation.

Briefly described, the aforementioned objects are accomplished according to the invention by providing a foldable cardboard or plastic blank comprising a flat rectangular central or "spine" section, with two lateral flaps each attached by an integrally formed hinge to the longer sides of the central section and upper and lower flaps each attached by an integral hinge to the upper and lower sides of the spine section, respectively. Each lateral flap is provided with a pair of grooves extending perpendicularly from the central section. The lateral edges of the upper and lower flaps are constructed to releasably engage in the grooves of the lateral flaps by a "snap" fit or tongue-and-groove arrangement so that the lateral flaps may be releasably secured to the upper and lower flaps to from the book box of the invention.

The lower flap is provided with a transversely extending groove near the outermost end thereof to receive the outermost end of the upper flap in a "snap fit" or tongue-and-groove arrangement. When both upper and lower flaps are folded rearwardly, the end of the upper flap may be snapped into the groove of the lower flap, thus connecting the upper flap to the lower flap to provide an inclined book rest support.

With these and other objects, advantages and features of the invention that may become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
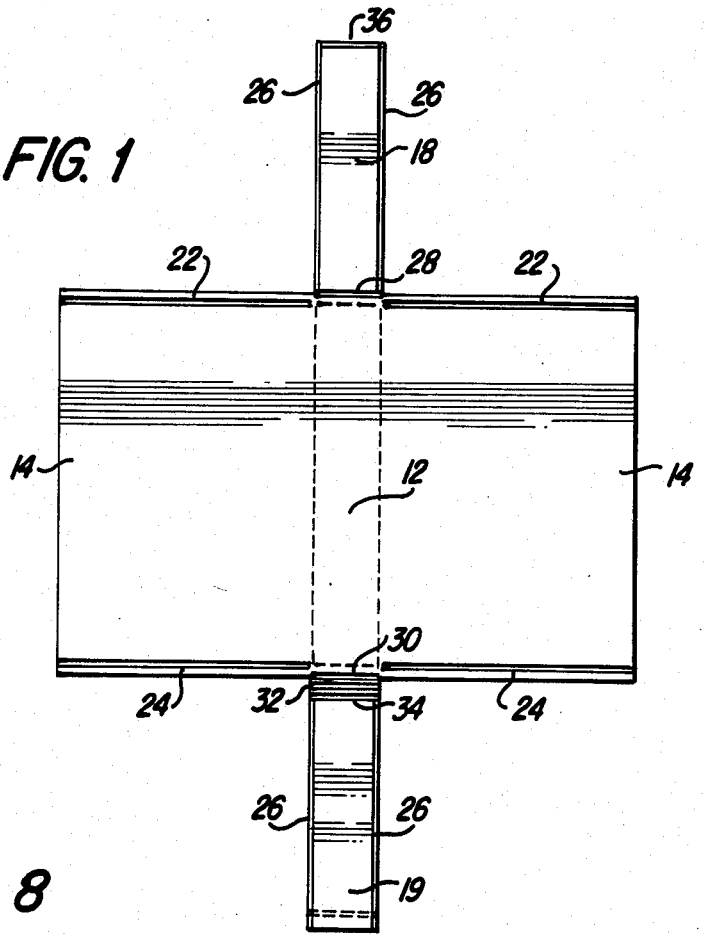
FIG. 1 is a plan view of the inner surface of the foldable blank for the book rest/book box of the invention.
Figure 2:
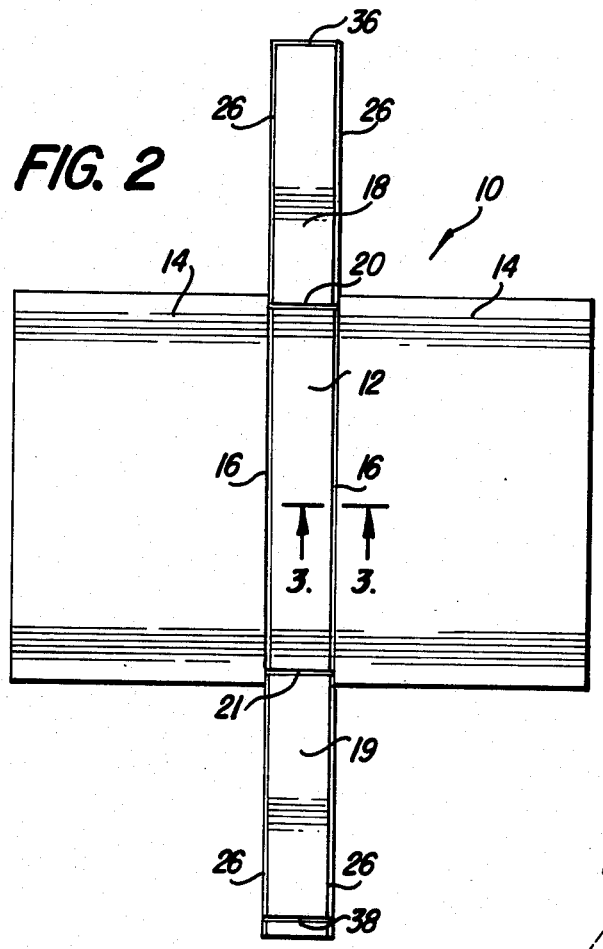
FIG. 2 is a plan view of the outer surface of the foldable blank for the book rest/book box of the invention.

Referring now in detail to the drawings, there is illustrated in FIGS. 1 and 2 an embodiment of the foldable blank 10 from which the convertible book rest/book box of the present invention is formed. The foldable blank is preferably constructed by molding a one-piece flat sheet of plastic material. Blank 10 comprises a rectangular central or spine section 12, having lateral sides to which rectangular flaps 14 are connected by hinges 16 (FIG. 2) which are preferably integrally molded in the plastic material.

Figure 3:
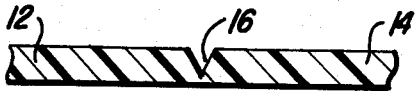
FIG. 3 is a fragmentary cross-sectional view taken along line 3—3 of FIG. 2.

One preferred form of the integral hinge construction is shown in cross-section in FIG. 3 as a V-shaped groove or indentation extending to a depth of more than half the thickness of the blank material. Other shapes of the integral hinge groove may be used, e.g., semicircular, V-shaped, rectangular, etc., and other flexible hinge constructions may be used, for instance, by bonding a flexible plastic or fabric material between a separately formed spine section 12 and separately formed lateral flaps 14.

Upper and lower rectangular flaps 18, 19 extend from the narrow ends of the spine section 12 and are hingedly connected thereto by integral hinges 20, 21 which are preferably formed in the same manner as the hinges 16 shown in FIG. 3.

Referring to FIG. 1, a pair of parallel grooves 22, 24 are formed in the inner surface of each of the lateral flaps 14 and extend perpendicularly from the lateral sides of the spine section 12. The grooves 22, 24 lie closely adjacent to the upper and lower edges of the flaps 14 and are preferably in alignment with a respective hinge 20, 21 connecting the spine section 12 with the upper and lower flaps 18, 19. The grooves 22, 24 preferably have a rounded or bulbous shape in cross-section. The lateral edges of both sides of the upper and lower flaps are formed with rounded edges 26, also bulbous in cross-section, for releasably engaging in and mating with the grooves 22, 24 of the lateral flaps 14 in a "snap fit" or tongue-and-groove arrangement.

Figure 8:
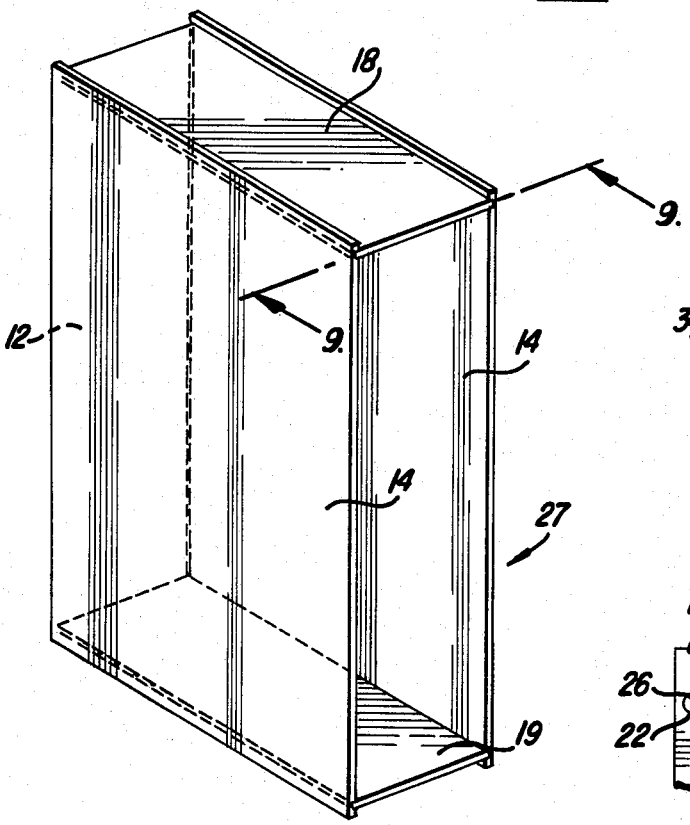
FIG. 8 is a perspective view showing the blank of FIGS. 1 and 2 folded into the book box configuration.
Figure 9:
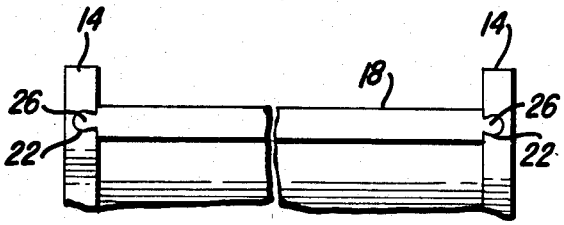
FIG. 9 is a fragmentary cross-sectional view taken along line 9—9 of FIG. 8.

The book box configuration of the foldable blank 10 shown in FIG. 8 is formed by folding or pivoting the two lateral flaps 14 and the upper and lower flaps 18, 19 upwardly about their respective hinges 16 and 20, 21 into the shape of a rectangular box 27. The bulbous edges 26 of both the upper and lower flaps 18, 19 are snapped into the mating grooves 22, 24 as shown in the detail of FIG. 9 to thereby releasably secure the blank in the book box configuration 27.

As best seen in FIG. 1, the inner surface of the upper flap 18 is provided with a transverse slot 28 generally aligned with the upper edges of the lateral flaps 14. Similarly, the inner surface of the lower flap is provided with a plurality of parallel transverse slots 30, 32, 34, the first one 30 of which is generally aligned with the lower-edges of the lateral flaps 14. The slots 28–34 are preferably rectangular in cross-sectional shape as illustrated, but may be of any other suitable shape, such as V-shape, U-shape, semicircular, etc., consistent with the pivoting function to be served by the slots as hereinafter described.

Referring again to FIG. 2, the outermost extremity of the upper flap 18 is provided with a rounded or bulbous edge 36, preferably having the same cross-sectional shape as the edges 26. The outer surface of the lower flap 19 is provided with a transverse groove 38 spaced a short distance from the outermost extremity of the flap 19. The groove 38 has a cross-sectional shape corresponding to the bulbous edge 36 to provide a releasable "snap fit" or tongue-and-groove arrangement therewith.

Figure 4:
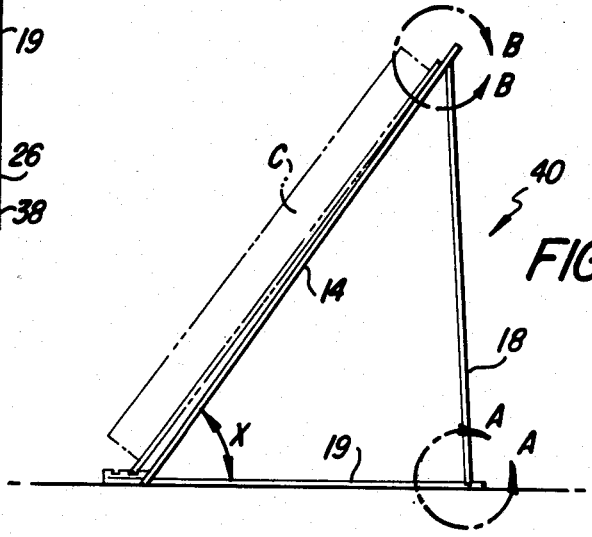
FIG. 4 is a side elevation view showing the blank folded into a book rest configuration.
Figure 6:
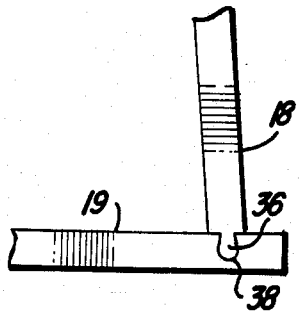
FIG. 6 is a fragmentary side view of detail A of the configuration of FIG. 4.

To form the book rest configuration of the folable blank 10, the upper and lower flaps 18, 19 are pivoted rearwardly as viewed in FIG. 1 about slot 28 and one of the slots 30–34 to form a triangular book rest support 40 as shown in FIG. 4, comprising the spine section 12 and the upper and lower flaps 18, 19, with the lateral flaps 14 extending laterally from the spine section 12. To releasably secure the book rest 40 in the configuration of FIG. 4, the outermost edge 36 of the upper flap 18 is snapped into the slot 38 of the lower flap 19 as particularly shown in the detail of FIG. 6.

Adjustment of the inclination of the book rest 40 is accomplished by appropriate selection of one of the slots 30–34 of the lower flap 19 for the rearward pivoting of the lower flap which determines the length of the base of the triangular support and thus the magnitude of the angle of inclination X of the book rest.

Figure 5:
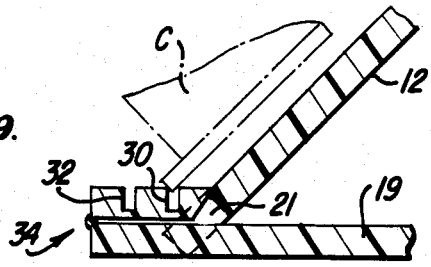
FIG. 5 is a fragmentary view, partly in cross-section, of the configuration of FIG. 4 showing a book resting on the base of the book rest.
Figure 7:
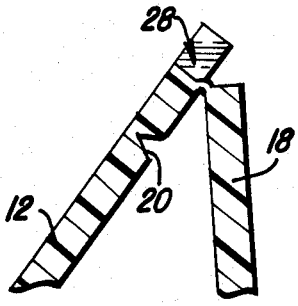
FIG. 7 is a fragmentary cross-sectional side view of detail B of the configuration of FIG. 4.

FIGS. 5 and 7 show in cross-section the details of the pivot means at the upper and lower ends of the spine section. As seen in FIG. 5, the lower flap 19 is pivoted 180° back upon itself about slot 34. Thus, a generally planar support is advantageously provided upon which the spine of a book C may rest in secure engagement with one of the slots 30 or 32.

Those skilled in the art will appreciate that additional slots may be provided in the lower flap 19 adjacent the slots 30–34 to increase the range of adjustment of the angle of inclination of the book rest 40. In addition, it would also be possible to provide adjustment of the inclination of the book rest by providing a plurality of slots adjacent slot 38 at the outermost extremity of the lower flap.

Although only a presently preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. A convertible book rest/book box device comprising:

a flat rectangular spine section having an inner surface and an outer surface, two side edges and two end edges;

first and second flat lateral flaps, each having an inner surface and an outer surface, and being attached by first hinging means along a respective side edge of said spine section;

upper and lower flat flaps, each having two ends, an inner surface and an outer surface and two lateral edges, each of said upper and lower flaps being attached at one of said two ends by second hinging means to a respective end edge of said spine section, the other of said two ends of each of said upper and lower flaps terminating in a free end;

groove forming means disposed in the inner surfaces of said lateral flaps for receiving the lateral edges of said upper and lower flaps in releasably interlocking relation; and means disposed in said upper and lower flaps for releasably securing such flaps together adjacent the free ends thereof;

whereby the lateral edges of the upper and lower flaps may be releasably interlocked in the groove forming means of the lateral flaps to form said book box or the upper and lower flaps may be releasably interlocked together adjacent the free ends thereof to form said book rest with a predetermined angle of inclination.

2. The device according to claim 1, wherein said spine section, lateral flaps, upper and lower flaps and first and second hinging means comprise an integrally molded, one-piece, foldable blank.

3. The device according to claim 1, including means cooperating with said upper and lower flaps for adjusting the angle of inclination of the book rest.

4. The device according to claim 3, wherein said adjusting means comprises a plurality of transverse slots disposed in the inner surface of the lower flap adjacent the lower flap second hinging means, said slots comprising pivot forming means about which the lower flap is pivoted.

5. The device according to claim 1, wherein said releasably securing means comprises a slot in the outer surface of the lower flap for engaging the free end of the upper flap.

6. The device according to claim 1, wherein the lateral edges of the upper and lower flaps are bulbous in cross-section and the groove forming means in the lateral flaps have a cross-section complementary to the bulbous cross-section of the lateral edges of the upper and lower flaps.

7. The device according to claim 2, wherein said first and second hinging means are formed as V-shaped grooves.

8. The device according to claim 1, including means in the inner surface of said upper and lower flaps for pivoting said upper and lower flaps away from the inner surface of the spine section whereby said upper and lower flaps may be releasably secured together.

9. The device according to claim 2, wherein said foldable blank is molded of plastic.

10. The device according to claim 5, wherein the free end of the upper flap has an edge with a bulbous cross-section and the slot has a cross-section complementary to the bulbous cross-section of the edge of the free end of the upper flap.

11. A foldable blank adapted to be folded into a book box or book rest comprising:

a central rectangular member having opposite ends and opposite sides, a pair of lateral flaps hingedly mounted on the opposite sides of said central member;

a pair of elongated flaps each having two ends and side edges and being hingedly mounted at one of said two ends of each flap to a respective opposite end of the central member;

groove forming means on the lateral flaps for receiving the side edges of the elongated flaps in releasably interlocking relation for forming a container when said side edges are interlocked in said groove forming means; and means on each of said elongated flaps for releasably securing the elongated flaps to each other at the other of said two ends opposite the central member for forming an inclined book rest when said releasable securing means are secured.

* * * * *